United States Patent [19]

Henderson, Jr. et al.

[11] Patent Number: 4,978,147

[45] Date of Patent: Dec. 18, 1990

[54] ELASTOMERIC LOCKDOWN AND SHEAROUT DEVICE

[75] Inventors: Herman O. Henderson, Jr.; Mark Q. Henneke, both of Houston, Tex.

[73] Assignee: Vetco Gray Inc., Houston, Tex.

[21] Appl. No.: 515,244

[22] Filed: Apr. 27, 1990

[51] Int. Cl.[5] ..... F16L 35/08; E21B 33/04

[52] U.S. Cl. ..... 285/2; 285/3; 285/321; 166/82; 166/365; 166/368

[58] Field of Search ..... 166/75.1, 82, 85, 77.5, 166/365, 368, 376–378; 285/2, 3, 138, 139, 321, 918, 922; 403/2, 355, 372

[56] References Cited

U.S. PATENT DOCUMENTS

| | | | |
|---|---|---|---|
| 3,637,239 | 1/1972 | Daniel | 285/93 |
| 4,193,616 | 3/1980 | Sarson et al. | 285/39 |
| 4,407,482 | 10/1983 | Daghe et al. | 285/321 |
| 4,475,748 | 10/1984 | Ekman | 285/3 |
| 4,783,100 | 11/1988 | Klein | 285/321 |
| 4,872,710 | 10/1989 | Konecny et al. | 285/321 |

*Primary Examiner*—Bruce M. Kisliuk

*Attorney, Agent, or Firm*—James E. Bradley

[57] ABSTRACT

A device for retaining tubular inner and outer members together in a well allows the members to be pulled apart with a sufficient shear out force. The members have mating retaining and reaction groooves. The retaining groove has a deeper portion joining a shallower portion which is bounded by a shearing side wall. The reaction groove has a shearing side wall which opposes the shearing side wall of the retaining groove when the inner and outer members are fully inserted together. A solid elastomeric ring is carried within the retaining groove. The ring locates in the deeper portion when the inner and outer members are being pushed together. When a pulling apart force is applied, the shallower portion slides relative to the ring until the ring locates in the shallower portion and is contacted by the opposed shearing side walls. The protrusion of the ring from the shallower portion into the reaction groove is sufficient to prevent the inner and outer members from being pulled apart from each other unless sufficient pulling force is applied to cause the ring to shear.

6 Claims, 2 Drawing Sheets

ELASTOMERIC LOCKDOWN AND SHEAROUT DEVICE

BACKGROUND OF THE INVENTION

1. Field of the Invention

This invention relates in general to a device for locking together inner and outer members of an oil or gas well, and particularly to a locking device for locking a drilling wear bushing within a casing hanger.

2. Description of the Prior Art

There are instances in which an inner tubular member must be releasably locked into an outer tubular member within a well. For example, in a subsea well of the type concerned herein, a subsea wellhead housing will be located on the sea floor. A casing hanger will land in the subsea housing. The casing hanger locates at the top of a string of casing that extends into the well. An annular seal will seal between the casing hanger and the wellhead housing.

If the well is to be drilled deeper, the drilling rig at the surface of the water will run drill pipe down through the casing hanger and through the casing for drilling. It is important to avoid damaging the bore of the casing hanger, because eventually, a tubing hanger may land within the casing hanger for supporting production tubing. The operator will lower a wear bushing into the bore of the casing hanger to prevent damage to the casing hanger from the rotating drill pipe.

The wear bushing needs to be retained in the bore of the casing hanger. Without some type of retention mechanism, the wear bushing might be dislodged by circulation of heavy solids or by tripping of the drill pipe through the wellhead during normal drilling operations.

There are various mechanisms for retaining wear bushings, including shear pins, lock rings, or J pins made of steel or other metallic alloys. While workable, users have experienced failure in activating or releasing these devices. It is difficult to recover the wear bushing if the locking mechanism fails to release.

Elastomeric O-rings have been used in standard and shallow cut dove tail grooves on wear bushings to prevent the buildup of fine particles between the wear bushing outer diameter and the casing hanger inner diameter. In some cases, the O-ring will expand into a groove in the wellhead housing so as to resist premature unseating of the wear bushing. The amount of retention in these cases, however, is not sufficient to serve as the primary retention means for retaining the wear bushing with the casing hanger.

SUMMUARY OF THE INVENTION

In this invention, a retaining groove will be formed on one of the inner or outer members, and a reaction groove will be located on the other. These grooves will be positioned so that they will align with each other when the inner member or wear bushing, fully inserts within the outer member or casing hanger. The retaining groove has a deeper portion which joins a shallow portion and which is bounded by a shearing shoulder or side wall. The reaction groove also has a side wall which opposes the shearing side wall of the retaining groove when the inner and outer members are fully inserted together.

A solid elastomeric ring will be carried within the retaining groove. The ring locates in the deeper portion when the inner and outer members are being pushed together. It will protrude into the reaction groove when the inner member fully inserts into the outer member. Picking up on the inner member then causes the shallower portion of the retaining groove to slide upward relative to the ring until the ring locates in the shallower portion. The ring will then be contacted by the opposed shearing side walls. This retains the inner member within the outer member.

The protrusion of the ring from the shallower portion into the reaction groove is sufficient to prevent the inner and outer members from being pulled apart unless sufficient pulling force is applied to cause the ring to shear. Once sheared, a catcher groove located below the retaining groove will catch the portion sheared from the ring. Preferably, the elastomeric ring has a flat side which contacts the retaining groove. This flat side prevents the ring from rolling as the shallower portion slides upward relative to the ring.

DESCRIPTION OF THE INVENTION

Figure 1:
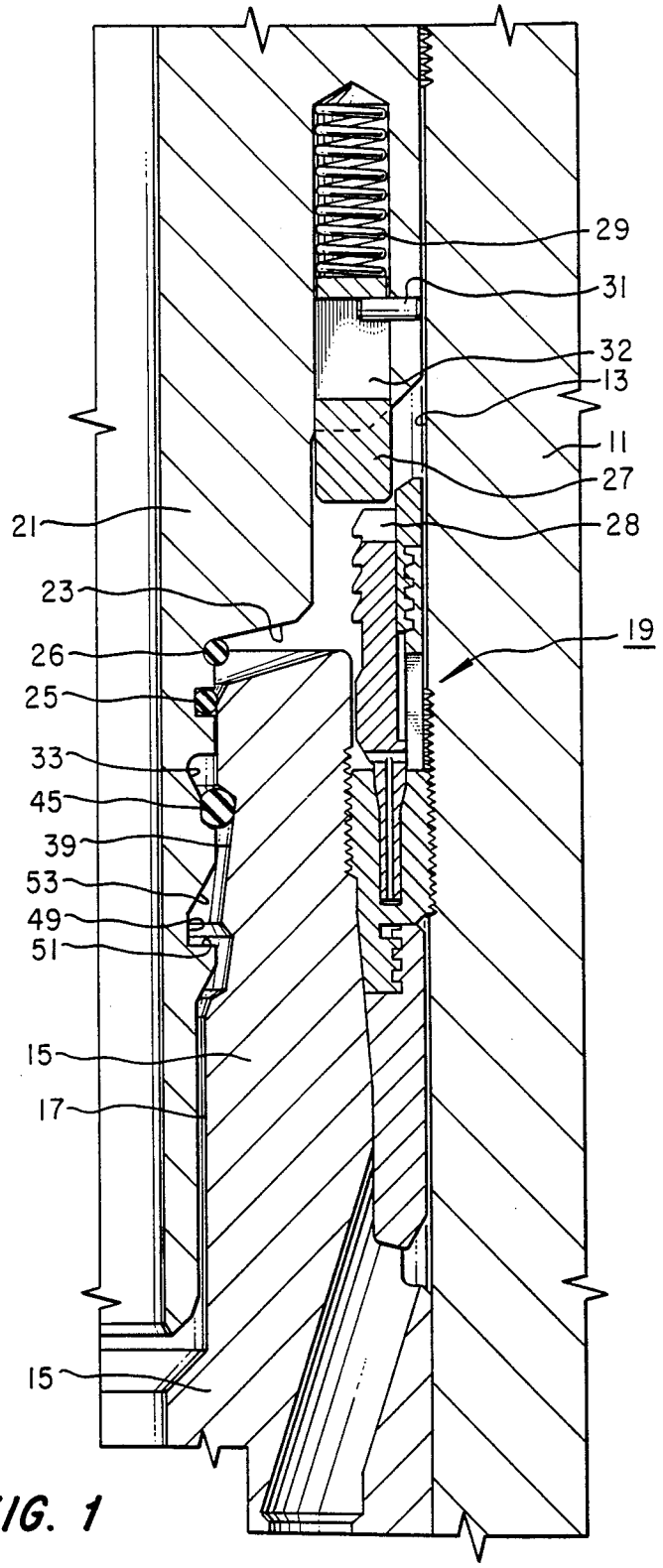
FIG. 1 is quarter sectional view of a casing hanger, wear bushing, and wellhead housing, showing a lockdown device constructed in accordance with this invention.

Referring to FIG. 1, wellhead housing 11 is a large tubular member located on the floor of the sea. Wellhead housing 11 has an axial bore 13. A casing hanger 15 lands within the bore 13. Casing hanger 15 will be secured to the upper end of a string of casing (not shown) which extends into the well to a selected depth. Casing hanger 15 has an axial bore 17. An annular seal assembly 19 seals between the casing hanger 15 and the wellhead housing 11.

In the embodiment shown, the operator will drill the well to a greater depth than the depth of the casing to which the casing hanger 15 is secured. Drill pipe will be lowered from a drilling rig (not shown) at the surface, through the casing hanger 15 and into the well for the additional drilling.

To prevent damage to the bore 17, the operator will install a wear bushing 21 in the bore 17. Wear bushing 21 is a tubular metal member with a lower portion which fits securely within the bore 17. An upper portion extends upward a short distance. A shoulder 23 divides the upper and lower portions. Shoulder 23 will land on the rim of the casing hanger 15 when the wear bushing 21 fully lands within the casing hanger 15. Seals 25 and 26 seal the lower portion of the wear bushing 21 to the bore 17.

Conventional means exist for preventing the wear bushing 21 from rotating relative to the casing hanger 15. In the embodiment shown, this includes a longitudinally extending pin 27 which engages a slot 28 located in the upper end of the seal assembly 19. A spring 29 urges the pin 27 downward. A radially extending pin 31 engages a slot 32 in the pin 27 to retain the pin 27.

The lockdown means for locking the wear bushing 21 to the casing hanger 15 includes a retaining groove 33. Retaining groove 33 is formed on the exterior of the lower portion of the wear bushing 21. Groove 33 is circumferential, extending continuously around the wear bushing 21. Groove 33 has a deeper portion 33*a* which leads to a shallower portion 33*b* directly below. The deeper portion 33*a* is arcuate in cross-section. The shallower portion 33*b* is cylindrical and substantially straight in cross-section The deeper portion 33*a* slopes gradually through a tapered, conical section to the shallower portion 33*b*.

The axial length of the deeper portion 33*a* is about the same as the axial length of the shallower portion 33*b*. The inner diameter of the deeper portion 33*a* is less than the inner diameter of the shallower portion 33*b*. In the embodiment shown, the depth of the shallower portion 33*b* is approximately 57 percent of the depth of the deeper portion 33*a*. The depth is measured by measuring the radial distance from the exterior of the lower portion of wear bushing 21 to the inner diameters of the portions 33*a*, 33*b*.

The deeper portion 33*a* leads smoothly into an insertion side wall 35 on its upper end. The insertion side wall 35 has a portion that is perpendicular to the longitudinal axis of the wear bushing 21 and faces downward. The shallower portion 33*b* leads on its lower end smoothly into a shearing side wall or shoulder 37. The shearing side wall 37 is curved, but faces generally upward and outward. The shearing side wall 37, including the transition portion from the shallower portion 33*b*, is about one-fourth of the radius of a circle.

The retaining groove 33 is positioned so as to locate directly across from a reaction groove 39 when the wear bushing 21 locates fully within the casing hanger 15. The reaction groove 39 in the embodiment shown is a conventional groove that has been present on prior art casing hangers 15 for other purposes, such as serving as means for connecting a running tool (not shown) for running the casing hanger 15 and seal assembly 19. The reaction groove 39 will still be used for the other purposes, but in this invention, has an additional function The reaction groove 39 in the embodiment shown thus has a conventional profile.

The reaction groove 39 will have a downward facing shoulder or side wall 41, which may be called a shearing side wall for the purposes of this invention. The shearing side wall 41 is a straight conical side wall, that faces downward and inward at about a 65 degree angle relative to the longitudinal axis of the casing hanger 15. The remaining portion of the reaction groove 39 is also conical, tapering downward about a ten degree angle relative to the longitudinal axis of the casing hanger 15. In the embodiment shown, the maximum depth of the reaction groove 39, which is at the intersection of the shearing side wall 41 with the remaining portions of groove 39, is about the same as the depth of the retaining groove shallower portion 33*b*. A bevel 43 will be located on the bore 17 of the casing hanger 15 at the rim of the casing hanger 15.

An elastomeric ring 45 locates in the retaining groove 33. Ring 45 is preferably of a buna N material, having a hardness of 85–95 durometer. Ring 45 is solid and continuous, not split at any point. In the embodiment of FIGS. 1–5, ring 45 has the shape of an O-ring, except for a flat 47 formed on its inner diameter. This gives ring 45 the general shape of a "D". The flat 47 is in a longitudinal plane and offset from the center line 55 of the cross-sectional diameter of ring 45. Flat 47 will be positioned so that it will contact the shallower portion 33*b* when the wear bushing 21 is pulled upward from the casing hanger 15.

Figure 4:
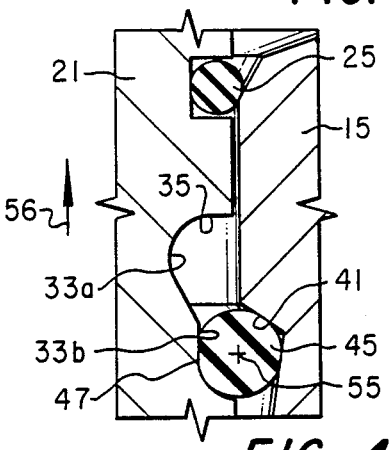
FIG. 4 is an enlarged view of a portion of the lockdown device of FIG. 1, showing the wear bushing being pulled upward relative to the casing hanger.
Figure 5:
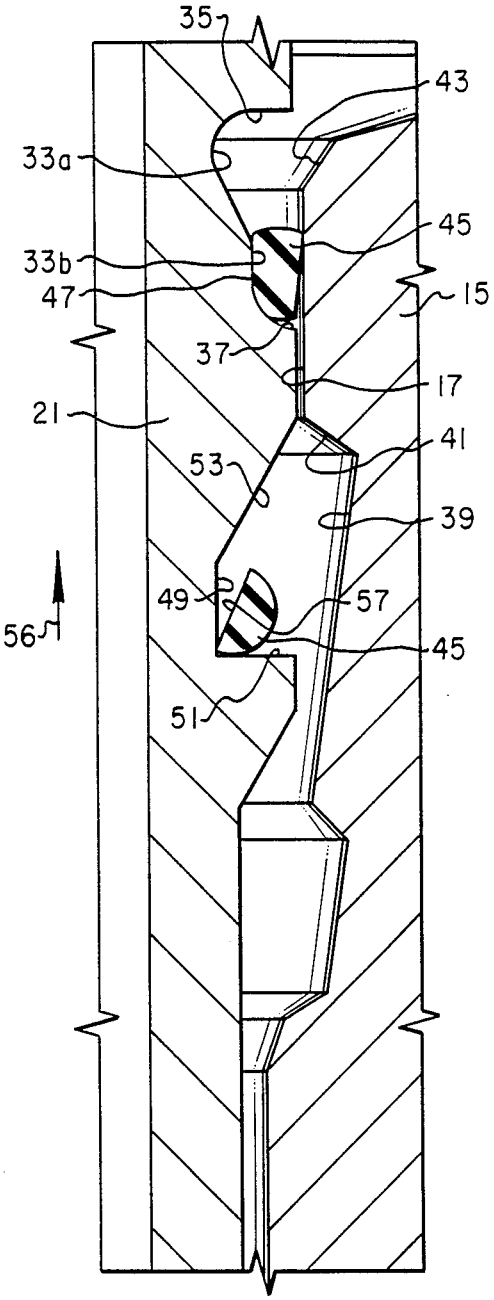
FIG. 5 is an enlarged cross sectional view of the lockdown device of FIG. 1, showing the wear bushing being pulled from the casing hanger, with the elastomeric ring sheared into two portions.
Figure 6:
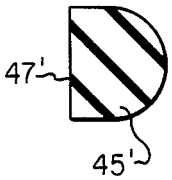
FIG. 6 is a cross sectional view of an alternate embodiment of the elastomeric ring used with the lockdown device of FIG. 1.

In the embodiment of FIG. 6, ring 45′ is the same, except the intersection of the flat 47′ with the cylindrical exterior of ring 45′ is not a radius, as in the embodiment of FIGS. 1–6. Rather, the surface joining the flat 47′ is perpendicular to the flat 47″ and tangent to the cylindrical portion of the ring 45′. This gives the ring 45′ more of a true "D" shape. In the embodiment of FIG. 6, the axial extent of the flat 47 is about the same as the axial extent of the ring 45 from its lowermost point to its uppermost point. In both embodiments, the radial distance from flat 47′ to the outer diameter of ring 45′ is about 83 percent of what the cross-sectional diameter of the ring 45′ would be if the flat 47′ did not exist.

Referring to FIGS. 1 and 6, a catcher groove 49 locates below the retaining groove 33. Catcher groove 49 will be spaced axially downward a selected distance below the shearing side wall 37. Catcher groove 49 has a lower side wall 51 that is perpendicular to the axis of the wear bushing 21. The catcher groove 49 has an upper side wall 53 that is conical and faces downward and outward. Catcher groove 49 serves to catch a portion of the ring 49 that is sheared, as illustrated in FIG. 6.

The cross-sectional diameter of the elastomeric ring 45 is the same as the diameter of the radius forming the retaining groove deeper portion 33*a*. The depth of the retaining groove deeper portion 33*a* is selected so that ring 45 will deform without any damage as the wear bushing 21 enters the casing hanger 15. Less than one half of the ring 45 will protrude outward from the retaining groove deeper portion 33*a*. Preferably, only about 24 percent of the ring 45 protrudes from the groove deeper portion 33*a*.

Figure 2:
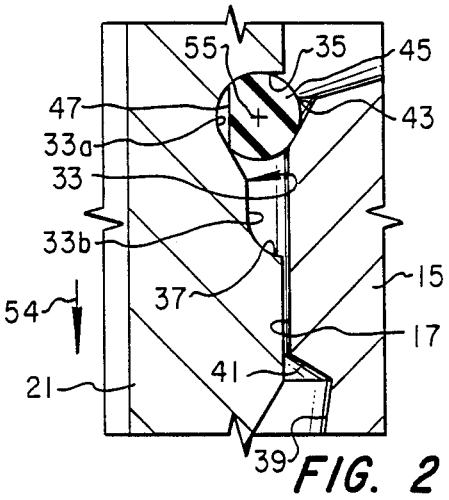
FIG. 2 is an enlarged sectional view of a portion of the lockdown device of FIG. 1, and showing the wear bushing in the process of being inserted into the casing hanger.
Figure 3:
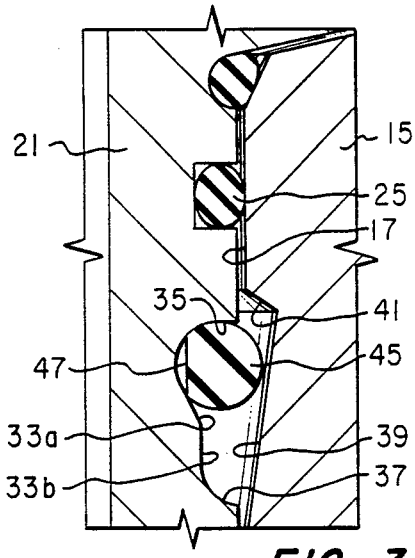
FIG. 3 is a cross sectional view of the lockdown device of FIG. 1, showing the wear bushing fully inserted into the bore of the casing hanger.

When the ring 45 is in the shallower portion 33*b*, approximately 44 percent of the ring 45 will protrude. These percentages are determined by dividing the radial distance from the outer diameter of the ring 45 to the exterior of the wear bushing 21 by the radial dimension of the ring 45 from flat 47 to the outer diameter of ring 45. The midpoint 55 will be recessed within the groove deeper portion 33*a* when the ring 45 is in the deeper portion 33*a*, as shown in FIG. 2. When in the shallower portion 33*a*, the midpoint 55 will also be recessed within the shallower portion 33*a*, but to a lesser extent.

In operation, the operator will lower the wear bushing 21 on a conventional running tool (not shown). Initially, the ring 45 will be located in the deeper portion 33*a* of the retaining groove 33, as shown in FIG. 2. The lower portion of the wear bushing 21 will stab into the bore 17 of the casing hanger 15. The elastomeric ring 45 will contact the bevel 43.

The insertion side wall 35 will force the ring 45 to deform as the wear bushing 21 moves downward into the casing hanger bore 17. Arrow 54 in FIG. 2 illustrates this downward movement. When the wear bushing 21 reaches its fully inserted position, illustrated in FIG. 3, the ring 45 will return back to its original configuration, with a portion protruding into the reaction groove 39. At this point, the ring 45 will not be touching any of the surfaces of the reaction groove 39. The ring 45 will still be located in the deeper portion 33*a*. The seal 25 will be sealing against the bore 17. The seal 26 will be in sealing contact with the bevel 43.

The operator will then pick up on the string to determine whether or not the wear bushing 21 has properly locked to the casing hanger 15. Arrow 56 in FIG. 4 illustrates this upward movement When this occurs, the wear bushing 21 will move upward a short distance relative to the casing hanger 15. The shallower portion 33*b* will move upward relative to the ring 45, but the ring 45 will be retained against movement by the shearing side wall 41 of the reaction groove 39. The shallower portion 33*b* will slide along the flat 47. The flat 47 will prevent the ring 45 from rolling during this upward movement.

When the shearing side wall 37 contacts the ring 45, the ring 45 will be pressed between the shearing side walls 37 and 41, as shown in FIG. 4. The operator will detect the increase in force as he pulls upward, and will thus determine that the wear bushing 21 is properly locked in place. He then can release the running tool and retrieve it to the surface. The operator will then lower a drill bit through the wear bushing 21 to begin drilling After drilling has been completed, to retrieve the wear bushing 21, the operator again lowers the running tool into engagement with the wear bushing 21. The operator picks up the drill string and applies upward force. Once a sufficient upward force has been applied, the ring 45 will shear along the shear line 57, as shown in FIG. 5. This releases the wear bushing 21 from the casing hanger 15. The operator can then begin pulling the wear bushing 21 back to the surface.

A portion of the ring 45 will remain in the retaining groove 33. The other portion of the ring 45 will be trapped by the catcher groove 49 after the wear bushing 21 moves up a short distance. The other portion of the ring 45 will remain in the catcher groove 49 and be brought to the surface along with the wear bushing 21.

The force required to insert the wear bushing 21 into the casing hanger 15 is much less than the force required to retrieve it This difference in force results because when inserting, the ring 45 locates in the deeper portion 33*a* of retaining groove 33, and when pulling, the ring 45 locates in the shallower portion 33*b*. Tests have shown that for one embodiment, the insertion force is less than 8,000 pounds. The pull out force is 50,000 pounds or greater.

The invention has significant advantages. The lockdown device effectively retains the wear bushing with the casing hanger. It is not as subject to failure as prior art mechanical locking devices. A much lighter push in force is required than a pull out force. The lockdown device can be used for applications other than a wear bushing within a casing hanger.

While the invention has been shown in only one of its forms, it should be apparent to those skilled in the art that it is not so limited, but is susceptible to various changes without departing from the scope of the invention.

We claim:

1. In a well having a tubular inner member adapted to insert within and be pulled from a bore of a tubular outer member, an improved means for retaining the inner and outer members together, comprising in combination:

a retaining groove and a reaction groove;

one of the grooves being formed in the bore of the outer member;

the other of the grooves being formed on the exterior of the inner member, the retaining and reaction grooves being positioned to locate adjacent each other when the inner member is fully inserted within the outer member;

the retaining groove having a deeper portion joining a shallower portion which is bounded by a shearing side wall;

the reaction groove having a shearing side wall which opposes the shearing side wall of the retaining groove when the inner and outer members are fully inserted together;

a solid elastomeric ring carried within the retaining groove, the ring locating in the deeper portion when the inner and outer members are being pushed together, the ring protruding into the reaction groove when the inner member is fully inserted into the outer member, the shallower portion sliding relative to the ring until the ring locates in the shallower portion and is contacted by the opposed shearing side walls when the inner and outer members are urged apart from each other; and the protrusion of the ring from the shallower portion into the reaction groove being sufficient to prevent the inner and outer members from being pulled apart from each other unless sufficient pulling force is applied to cause the ring to shear.

2. In a well having a tubular inner member adapted to insert within and be pulled from a bore of a tubular outer member, the inner and outer members having a common longitudinal axis when the inner and outer members are inserted together, an improved means for retaining the inner and outer members together, comprising in combination:

a retaining groove and a reaction groove;

one of the grooves being formed in the bore of the outer member;

the other of the grooves being formed on the exterior of the inner member, the retaining and reaction grooves being positioned to locate adjacent each other when the inner member is fully inserted within the outer member;

the retaining groove having a deeper portion joining a shallower portion which is bounded by a shearing side wall;

the reaction groove having a shearing side wall which opposes the shearing side wall of the retaining groove when the inner and outer members are fully inserted together;

an elastomeric ring carried within the retaining groove, the ring locating in the deeper portion when the inner and outer members are being pushed together, the ring protruding into the reaction groove when the inner member is fully inserted into the outer member, the shallower portion sliding axially relative to the ring until the ring locates in the shallower portion and is contacted by the opposed shearing side walls when the inner and outer members are urged axially apart from each other;

the ring being circular in transverse cross-section but for a flat section located on a side of the ring for contact with the shallower portion, to prevent the ring from rolling as the shallower portion slides axially relative to the ring; and the protrusion of the ring from the shallower portion into the reaction groove being sufficient to prevent the inner and outer members from being pulled apart from each other unless sufficient axial pulling force is applied to cause the ring to shear.

3. In a well having a tubular inner member adapted to insert within and be pulled from a bore of a tubular outer member, the inner and outer members having a common longitudinal axis when the inner and outer members are inserted together, an improved means for retaining the inner and outer members together, comprising in combination:

a retaining groove and a reaction groove;

one of the grooves being formed in the bore of the outer member;

the other of the grooves being formed on the exterior of the inner member, the retaining and reaction grooves being positioned to locate adjacent each other when the inner member is fully inserted within the outer member;

the retaining groove having a radially deeper portion joining a radially shallower portion which is bounded by a shearing side wall;

the reaction groove having a shearing side wall which opposes the shearing side wall of the retaining groove when the inner and outer members are fully inserted together;

a solid elastomeric ring carried within the retaining groove, the ring locating in the deeper portion when the inner member is being inserted into the outer member, the ring protruding into the reaction groove when the inner member is fully inserted into the outer member, the shallower portion sliding relative to the ring until the ring locates in the shallower portion and is contacted by the opposed shearing side walls when the inner and outer members are urged apart from each other;

the protrusion of the ring from the shallower portion into the reaction groove being sufficient to prevent the inner and outer members from being pulled apart from each other unless sufficient pulling force is applied to cause the ring to shear into first and second portions, with the first portion remaining in the shallower portion; and a catcher groove formed on the member containing the retaining groove and axially spaced therefrom, to receive and retain the second portion as the inner and outer members are pulled apart.

4. In a well system, an inner member adapted to insert within and be pulled from a bore of an outer member, an improved means for retaining the inner and outer members together, comprising in combination:

a retaining groove formed on the exterior of the inner member;

the retaining groove having a deeper portion joining a shallower portion which is bounded by a shearing side wall;

a shearing side wall on the outer member which opposes the shearing side wall of the retaining groove when the inner and outer members are fully inserted together;

a solid elastomeric ring carried within the retaining groove, the ring locating in the deeper portion when the inner and outer members are being pushed together, the shallower portion sliding relative to the ring until the ring locates in the shallower portion and is contacted by the opposed shearing side walls when the inner and outer members are urged apart from each other; and the protrusion of the ring from the shallower portion into engagement with the shearing side wall of the outer member being sufficient to prevent the inner and outer members from being pulled apart from each other unless sufficient pulling force is applied to cause the ring to shear.

5. In a subsea well having a tubular wear bushing adapted to be inserted downward into and be pulled upward from a bore of a tubular casing hanger, the wear bushing and casing hanger having a common longitudinal axis when the wear bushing lands within the casing hanger, the casing hanger having an internal groove with a downward facing shoulder, an improved means for retaining the wear bushing in the casing hanger, comprising in combination:

a retaining groove formed on the exterior of the wear bushing and positioned to locate adjacent the groove of the casing hanger when the wear bushing is fully inserted within the casing hanger;

the retaining groove having a radially deeper portion which joins below a shallower portion, the deeper portion having a lesser outer diameter than the shallower portion, the retaining groove being bounded on the upper termination of the deeper portion by an insertion side wall and bounded on the lower termination of the shallower portion by a shearing side wall;

a solid, continuous elastomeric ring carried within the retaining groove, the ring locating in the deeper portion when the wear bushing is being inserted into the casing hanger, with the insertion shoulder pressing downward on the ring and the ring deforming as the wear bushing moves into the casing hanger until the ring reaches and protrudes into the groove of the casing hanger;

any subsequent upward movement of the wear bushing relative to the casing hanger causing the shallower portion to slide upward relative to the ring until the ring locates in the shallower portion and is contacted by the shearing side wall and the downward facing shoulder of the groove in the casing hanger, thereby retaining the wear bushing in the casing hanger;

the ring being circular in transverse cross-section but for a flat section located on an inside diameter of the ring for contact with the shallower portion, to prevent the ring from rolling as the shallower portion slides axially relative to the ring; and the protrusion of the ring from the shallower portion into the groove of the casing hanger being sufficient to prevent the wear bushing from being pulled upward from the casing hanger unless sufficient axial pulling force is applied to cause the ring to shear.

6. A method of releasably retaining a tubular inner member within a bore of a tubular outer member in a well, comprising in combination:

forming a groove in the bore of the outer member;

forming another groove on the exterior of the inner member, one of the grooves being a retaining groove and the other of the grooves being a reaction groove;

providing the retaining groove with a deeper portion joining a shallower portion and which is bounded by a shearing side wall;

providing the reaction groove with a shearing side wall which opposes the shearing side wall of the retaining groove when the inner and outer members are fully inserted together;

placing a solid elastomeric ring within the retaining groove;

pushing the inner and outer members together, with the ring locating in the deeper portion as the inner and outer members are being pushed together, the ring protruding into the reaction groove when the inner member is fully inserted within the outer member; then to remove the inner member from the outer member, moving the inner and outer members apart from each other, with the shallower portion sliding relative to the ring until the ring locates in the shallower portion and is contacted by the opposed shearing side walls; and continuing to pull the inner and outer members apart from each other until a sufficient pulling force is applied to cause the ring to shear.

* * * * *